US006190193B1

(12) United States Patent
Wagner

(10) Patent No.: US 6,190,193 B1
(45) Date of Patent: Feb. 20, 2001

(54) ELECTRICAL CONTACT ELEMENT WITH A TERMINAL LUG AND A LATERALLY OFFSET CONTACT ZONE FOR USE IN A LAMP SOCKET

(75) Inventor: Jörg Wagner, Kaiserslautern (DE)

(73) Assignee: TRW Automotove Electronics & Components GmbH & Co. KG (DE)

( * ) Notice: Under 35 U.S.C. 154(b), the term of this patent shall be extended for 0 days.

(21) Appl. No.: 09/256,960

(22) Filed: Feb. 24, 1999

(30) Foreign Application Priority Data

Feb. 25, 1998 (DE) ..... 198 07 954

(51) Int. Cl.[7] ..... H01R 4/48
(52) U.S. Cl. ..... 439/336; 439/862
(58) Field of Search ..... 439/336, 335, 439/862, 667, 672

(56) References Cited

U.S. PATENT DOCUMENTS

| | | | | |
|---|---|---|---|---|
| 3,555,497 | * | 1/1971 | Watanabe | 439/857 |
| 3,810,072 | * | 5/1974 | Moore | 439/336 |
| 5,350,322 | * | 9/1994 | Kondo | 439/862 |
| 5,626,500 | * | 5/1997 | Yoshimura | 439/862 |
| 5,716,240 | | 2/1998 | Harada | 439/699.2 |

FOREIGN PATENT DOCUMENTS

| | | |
|---|---|---|
| 297 14 062 U1 | 10/1997 | (DE) . |
| 0 718 933 A1 | 6/1996 | (EP) . |
| 0 788 198 A2 | 8/1997 | (EP) . |
| 2212658 | 7/1974 | (FR) . |

OTHER PUBLICATIONS

Copy of European Search Report dated Jun. 25, 1999.

* cited by examiner

*Primary Examiner*—Lincoln Donovan
*Assistant Examiner*—Brian S. Webb
(74) *Attorney, Agent, or Firm*—Fay, Sharpe, Fagan, Minnich & McKee, LLP

(57) ABSTRACT

An electrical contact element 1 includes an elongate terminal lug 6 on a first end of the electrical contact element and a substantially rectangular contact zone 5 disposed on a second end of the electrical contact element. The contact zone 5 is laterally offset relative to the terminal lug 6. A U-shaped intermediate region 8 is disposed between the contact zone 5 and the terminal lug 6. The U-shaped intermediate region is connected to the contact zone 5 via a connection arm member 10 on one end thereof and is connected to the terminal lug 6 via a radius zone 12 on the other end thereof. The U-shaped intermediate region includes an upper leg member 14, an intermediate leg member 15, and a lower leg member 16. A plurality of connection zones shaped as radii or circular curved portions $Z_1$, $Z_2$, $Z_3$, and $Z_4$ are formed between the rectangular contact zone 5, the connection arm 10, the upper leg member 14, the intermediate leg member 15, and the lower leg member 16, respectively.

20 Claims, 2 Drawing Sheets

ELECTRICAL CONTACT ELEMENT WITH A TERMINAL LUG AND A LATERALLY OFFSET CONTACT ZONE FOR USE IN A LAMP SOCKET

BACKGROUND OF THE INVENTION

The subject invention is directed to the art of electrical contact elements for application in lamp sockets and, more particularly, to an electrical contact element with a contact zone to be acted upon by electrical lamp contacts, the contact zone being laterally offset from a terminal lug of the electrical contact element.

A wide range of generic electrical contact elements of the type generally under consideration are commonly used in the lighting art to enable electrical connection to an electric lamp disposed in a lamp base. Typically, the electrical contact elements are uniquely designed and formed to meet particular applications. Thus, they are highly specialized and are therefore usable only in a narrow range of applications. In addition, electrical contact elements generally experience a relatively short service life because of their special construction and design.

In contrast thereto, it is an object of the present invention to provide an electrical contact element of the type under consideration which is able to fulfill its function correctly and without trouble over an extended period of time and service life and which can be employed with various lamp socket sizes and arrangements.

SUMMARY OF THE INVENTION

This object is achieved according to the invention in that a contact zone on one end of the electrical contact element that is adapted to engage electrical contacts of an electric lamp or bulb, is arranged in a laterally offset position relative to a terminal lug on the opposite end of the electrical contact element. The object is further achieved in that an intermediate region is provided in the electrical contact element disposed between the contact zone and the terminal lug. The intermediate region is generally U-shaped and is formed to include a connection arm member for connecting the contact zone with the U-shaped intermediate region. Further, a radius zone is provided for connecting the terminal lug with the U-shaped intermediate region. A set of connection zones are provided between the contact zone member, the connection arm member, and the U-shaped intermediate zone and, in accordance with the present invention, are formed as circular curved connection zones or equivalently as radii to enable resilient flexibility in the electrical contact element.

The size, shape, and arrangement of the subject electrical contact element, in particular the radii or circular curved connection zones, benefit the subject electrical contact element by significantly extending the usable service life thereof. In particular, since the electrical contact element according to the present invention has an improved spring effect or resilient nature due to the radii of the connection zones, pressure forces, such as compressive forces, are better absorbed and the electrical contact element can be used in a wide range of electric lamp socket applications. A further result of the novel structure of the invention is a secure contact with the socket of an electric light bulb as well as improvement in the insertion force of the holding device, whereby, additionally, there is a decrease in the pull-out moment relative to the terminal lug or plug-in contact. As a result of the lateral offset arrangement of the contact zone relative to the terminal lug, the range of application of the subject electrical contact element is expanded so that the contact element can be used with a wide range of different lamp shapes, sizes, and configurations such as, for example, brake light lamps, indicator lamps, and automotive tail lamps. The electrical contact element of the subject invention can be used in suitable associated electric sockets with all of the above lamp types and others as well.

In a further embodiment of the present invention, the lateral offset between the contact zone and the terminal lug is formed at least in part by the U-shaped intermediate zone portion of the electrical contact element. In addition, the lateral offset between the contact zone and the terminal lug is further formed by the connection arm member disposed between the contact zone and a lower leg member of the U-shaped intermediate zone.

In accordance with another aspect of the invention, the U-shaped intermediate zone includes a leg provided with a contact which extends outwardly away from the U-shaped intermediate zone in a plane defined by the lower leg member.

In accordance with a further aspect of the invention, the elongate terminal lug on one end of the electrical contact element is positioned at a right angle relative to the contact arm and the lower leg member of the U-shaped intermediate zone and, further, has a width that is less than the width of the leg.

It is an advantage of the present invention that the manufacture of the subject electrical contact element is simplified by a recess provided in the form of a radius between the contact arm extending outwardly from the U-shaped intermediate zone and a radius zone on one end of the terminal lug.

In accordance with a still further limited aspect of the invention, the terminal lug and contact arm have a material thickness that is greater than the material thickness of the intermediate region and of the contact zone.

In accordance with one embodiment of the invention, the entire electrical contact element is formed as a single unitary construction. In an alternative preferred embodiment of the invention, the electrical contact element is formed of at least two pieces connected together. The at least two pieces have at least two different material thicknesses including a thick portion defining the contact arm member and the elongate terminal lug and a thin portion defining the U-shaped intermediate region and the contact zone. Preferably, the two pieces of different material thicknesses are butt-welded together.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof, and wherein.

DETAILED DESCRIPTION OF THE PREFERRED EMBODIMENTS

Figure 1:
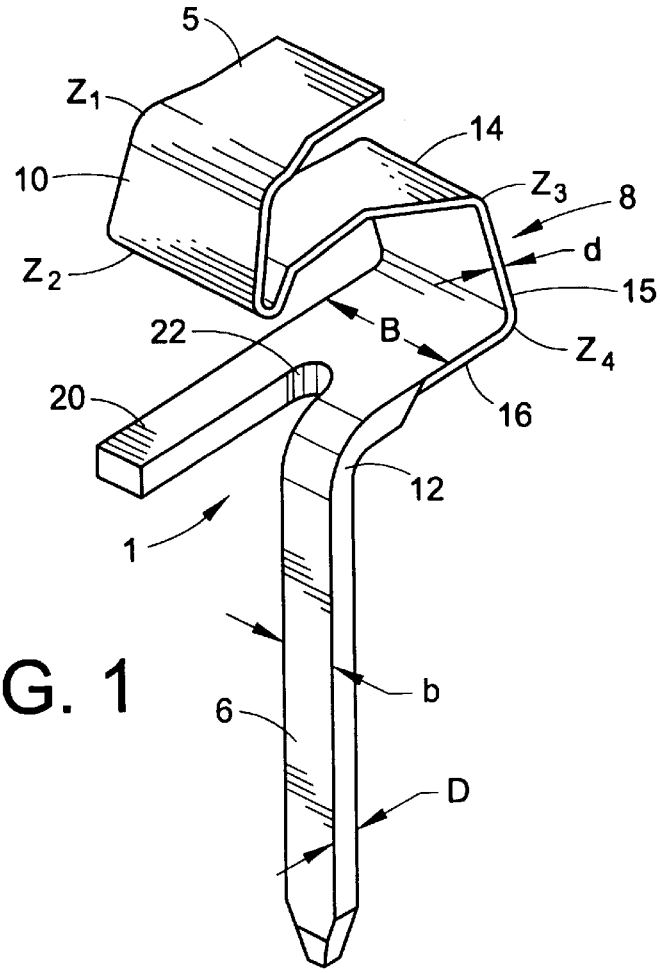
FIG. 1 is an isometric perspective view showing the overall arrangement of an electrical contact element formed in accordance with the preferred embodiment of the invention.
Figure 3:
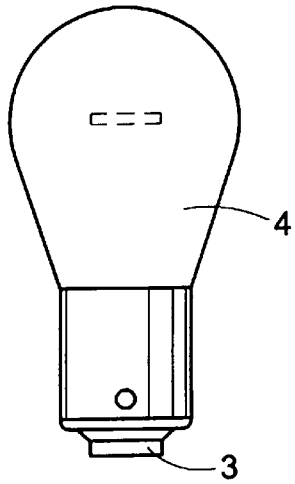
FIG. 3 is a front elevational view of an electric brake light lamp for use with the subject electrical contact element.
Figure 4:
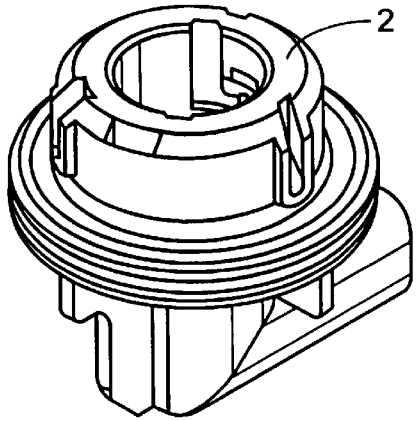
FIG. 4 is an isometric perspective view showing a lamp socket for receiving the subject electrical contact element; and, FIG. 5 is a cross-sectional view of a brake light lamp inserted into a lamp socket showing the subject electrical contact element installed in the lamp socket and engaging electrical contacts of the brake light lamp.
Figure 5:
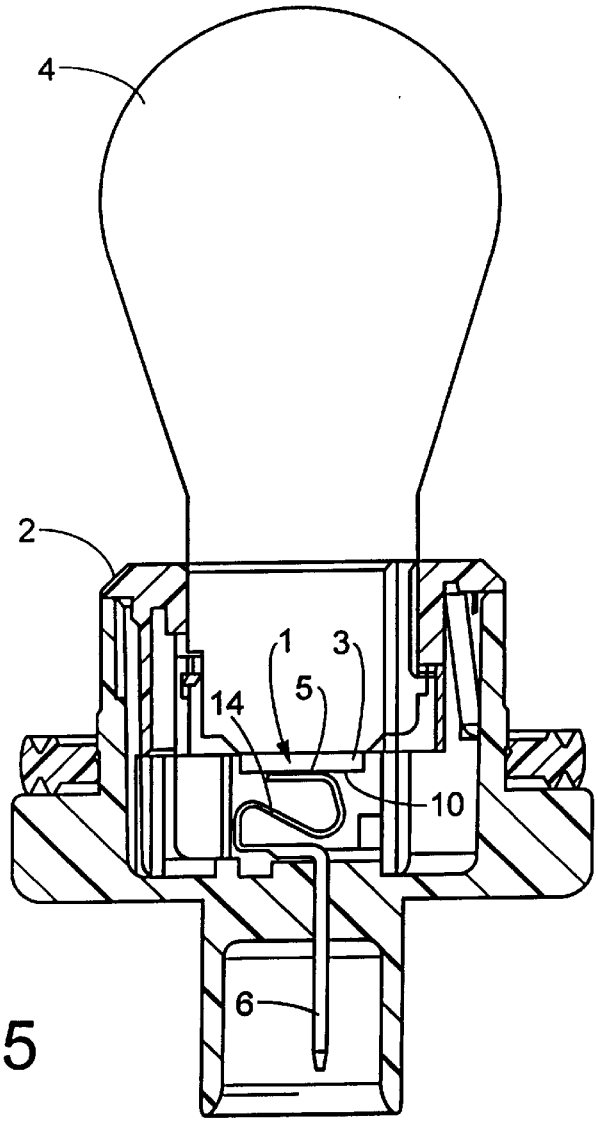

Referring now to the drawings wherein the showings are for the purposes of illustrating the preferred embodiments of the invention only and not for purposes of limiting same, the overall arrangement of the preferred form of an electrical contact element formed in accordance with the invention can best be seen by reference to FIG. 1. As shown thereat, the electrical contact element 1 comprises a generally rectangular contact zone 5 on one end thereof and an elongate terminal lug 6 on the other end. Preferably, the subject electrical contact element 1 is formed of a resilient flexible metal and serves for application in a lamp socket 2 such as shown in FIGS. 4 and 5. The rectangular contact zone is arranged so that it can be acted upon by a contact 3 of a lamp or bulb 4 (FIG. 3) and is electrically connected to the terminal lug 6 for electrically connecting the lamp contact 3 to an associated electrical connector adapted to engage the lamp socket 2 in a manner well known in the art.

Figure 2:
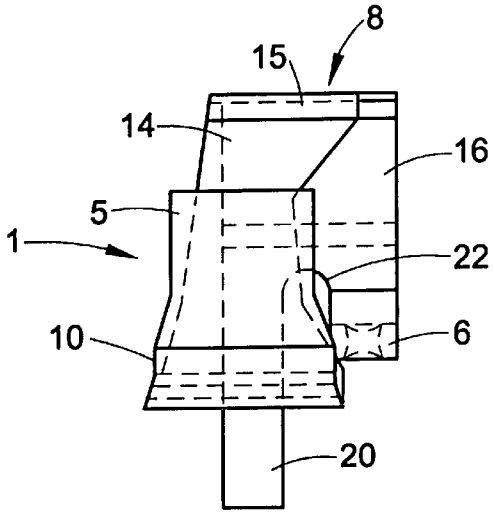
FIG. 2 is a top plan view of the electrical contact element shown in FIG. 1.

As can be seen best in FIGS. 1 and 2, the rectangular contact zone 5 is arranged in a laterally offset position relative to the terminal lug 6. FIG. 1 best shows an intermediate region 8 disposed between the contact zone 5 and the terminal lug 6. Preferably, as shown in the figures, the intermediate region 8 is formed in the general shape of the letter "U", although other suitable shapes can be used as well, and is connected to the contact zone 5 via a connection arm member 10. In addition, the U-shaped intermediate region 8 has a radius zone 12 for connecting the terminal lug 6 with the intermediate region 8.

The U-shaped intermediate region 8 is formed from thin flexible metal and defines three leg portions shown best in FIG. 1 to include an upper leg member 14, an intermediate leg member 15, and a lower leg member 16.

Of particular importance in the present invention, a plurality of connection zones $Z_1$, $Z_2$, $Z_3$, and $Z_4$ are provided to enhance the resilient flexibility of the subject electrical contact element. As best shown in FIG. 1, a first connection zone $Z_1$ is formed between the rectangular contact zone 5 and the connection arm member 10. A second connection zone $Z_2$ is disposed between the connection arm member 10 and the upper leg member 14. A third connection zone $Z_3$ is located between the upper leg member 14 and the intermediate leg member 15. Lastly, a fourth connection $Z_4$ is provided between the intermediate leg member 15 and the lower leg member 16. As shown, each of the connection zones are formed as circular curved connection zones and are each therefore respectively designed as radii. Other suitable curved profiles could be used as well. The radii or circular curved shape is significant to the present invention since the shape results in an increase in the service life of the entire electrical contact element 1. The connection zones formed as radii or circular curved portions enable use and reuse of the electrical contact element by providing an enhanced springiness and resilient nature to the electrical contact element.

The lateral offset between the rectangular contact zone 5 and the terminal lug 6 enables the electrical contact element 1 to be used in a wide range of applications such as, for example, for use with brake lights or with left or right side tail lamps. It is an advantage of the present invention that the electrical contact element 1 can be installed in a simple fashion into a range of lamp sockets 2 such as shown in FIGS. 4 and 5 with the guarantee of long service life and high operating security.

With reference once again to FIG. 1, the lower leg member 16 of the U-shaped intermediate zone 8 is provided with an elongate contact arm member 20. The contact arm member 20 extends outwardly from the electrical contact element 1 in the plane defined by the lower leg member 16. As can be seen, the contact arm member 20 is carried on the lower leg member 16 in a manner that the contact arm member 20 and the lower leg member 16 are oriented at a right angle relative to the terminal lug 6. Further as shown in FIG. 1, the width B of the lower leg member 16 is greater than the width b of the terminal lug 6. In accordance with the present invention, the width b of the terminal lug 6 is smaller than half the width B of the lower leg member 16. Further, as shown best in FIG. 1, a recess 22 shaped in the form of a radius is defined between the contact arm member 20 and the radius zone 12. The contact arm member 20 carried on the lower leg member 16 is provided in order to enable removal of the electrical contact element 1 from lamp socket housings as necessary. In that way, the contact arm 20 acts as a tab that is useful to pry the subject electrical contact element 1 from associated lamp socket housings as may be necessary.

As is evident in FIG. 1, the terminal lug 6 and the elongate contact arm member 20 each have a greater material thickness D than the material thickness d of the intermediate region 8 and the contact zone 5. In that way, the contact arm 20 and the terminal lug 6 are stiff relative to the U-shaped intermediate region 8 and the rectangular contact zone 5.

In accordance with a first preferred embodiment of the invention, the entire electrical contact element 1 is formed as a single unitary piece construction. Alternatively, in another preferred embodiment of the invention, the subject contact element is formed of at least two pieces connected together, the at least two pieces having at least two different material thicknesses including a first material thickness D and a second material thickness d. Preferably, the contact arm member 20 and the terminal lug 6 are formed to have the first material thickness D. Also, preferably, the contact zone 5 and the U-shaped intermediate region 8 are formed to have the second material thickness d. In the second preferred alternative embodiment of the invention, the contact arm member 20 and the terminal lug 6 are butt-welded to the lower leg member 16 of the U-shaped intermediate region 8 using welding techniques commonly known in the art.

As noted earlier, the unique construction and shape of the subject electrical contact element 1 according to the present invention significantly increases the service life and applicability of the electrical contact element into a wide range of applications.

The invention has been described with reference to the preferred embodiments. Obviously, modifications and alterations will occur to others upon a reading and understanding of this specification such as, for example, forming the various electrical contact areas to have widths, thicknesses and shapes different from those described above and to provide more or less lateral offset of the contact zone relative to the terminal lug. It is intended to include all such modifications and alterations insofar as they come within the scope of the appended claims or the equivalents thereof.

Having thus described the invention, it is claimed:

1. An electrical contact element for use in an associated electric lamp socket to make electrical contact with an electric lamp positioned in the lamp socket, the electrical contact element comprising:

an elongate terminal lug on a first end of the electrical contact element, the elongate terminal lug extending in a first direction;

a contact zone disposed on a second end of the electrical contact element, the contact zone being laterally offset on the electrical contact element relative to said first direction of the elongate terminal lug;

a U-shaped intermediate region disposed between the elongate terminal lug and the contact zones the U-shaped intermediate region including an upper leg member, an intermediate lea member, and a lower leg member, said relative lateral offset between the contact zone and the elongate terminal lug being formed by the upper leg member, the intermediate leg member, and the lower leg member;

a curved radius zone connecting the U-shaped intermediate region with the elongate terminal lug;

a connection arm member disposed between the contact zone and the U-shaped intermediate region;

a first circular curved connection zone $Z_1$ connecting the contact zone with the connection arm member; and, a second circular curved connection zone $Z_2$ connecting the contact arm member with the U-shaped intermediate region.

2. The electrical contact element according to claim 1 wherein at least a portion of said relative lateral offset between said contact zone and said elongate terminal lug is formed by said connection arm member.

3. The electrical contact element according to claim 1 further including a contact arm member extending from said U-shaped intermediate region in a second direction substantially perpendicular to said first direction of said elongate terminal lug for assisting in removing the electrical contact element from said associated electric lamp socket.

4. The electrical contact element according to claim 3 wherein said lower leg member and said contact arm member are disposed in a first plane.

5. The electrical contact member according to claim 1 wherein:

said lower leg member has a first width B;

said elongate terminal lug has a second width b, the second width b being less than said first width B; and, said elongate terminal lug is oriented at substantially a right angle relative to said lower leg member of said U-shaped intermediate region.

6. The electrical contact member according to claim 5 wherein said second width b of the elongate terminal lug is less than half of said first width B of the lower leg member.

7. The electrical contact member according to claim 6 further including a curved recess defined between said contact arm member and said curved radius zone.

8. The electrical contact member according to claim 1 wherein:

the elongate terminal lug and the contact arm have a first material thickness D; and, the U-shaped intermediate region and the contact zone have a second material thickness d, the second thickness d being less than said first thickness B.

9. The electrical contact member according to claim 8 wherein the electrical contact member is a unitary construction and formed of as a single piece.

10. The electrical contact member according to claim 8 wherein the electrical contact member is formed of at least two pieces connected together, the at least two pieces having at least two different material thicknesses including said first material thickness and said second material thickness.

11. The electrical contact member according to claim 10 wherein the contact arm and the elongate terminal lug are butt welded to the U-shaped intermediate region.

12. The electrical contact member according to claim 1 wherein:

said lower leg member has a first width B;

said elongate terminal lug has a second width b, the second width b being less than said first width B;

the elongate terminal lug and the contact arm have a first material thickness D; and, the U-shaped intermediate region and the contact zone have a second material thickness d, the second thickness d being less than said first thickness D.

13. The electrical contact element according to claim 1 further comprising:

a third circular curved connection zone $Z_3$ connecting said upper leg member with said intermediate leg member; and, a fourth circular curved connection zone $Z_4$ connecting said intermediate leg member with said lower leg member.

14. An electrical contact element for use in an electric lamp socket to make electrical contact with an electric lamp positioned in the lamp socket, the electrical contact element comprising:

an elongate terminal lug on a first end of the electrical contact element;

a contact zone on a second end of the electrical contact element, the contact zone being laterally offset on the electrical contact element relative to said elongate terminal lug;

a U-shaped intermediate region disposed between the elongate terminal lug and the contact zone, the U-shaped intermediate region including an upper leg member, an intermediate leg member, and a lower leg members said relative lateral offset between said contact zone and said elongate terminal lug being formed by the upper leg member, the intermediate leg member, and the lower leg member;

a curved radius zone connecting the U-shaped intermediate region with the elongate terminal lug;

a contact arm member disposed between the contact zone and the U-shaped intermediate region;

a first circular curved connection zone $Z_1$ formed as a radii connecting the contact zone with the contact arm member;

a second circular curved connection zone $Z_2$ formed as a radii connecting the contact arm member with the upper leg member;

a third circular curved connection zone $Z_3$ formed as a radii connecting the upper leg member with the intermediate leg member; and, a fourth circular curved connection zone $Z_4$ formed as a radii connecting the intermediate leg member with the lower leg member.

15. The electrical contact element according to claim 14 further including a contact arm member extending from said U-shaped intermediate region in a direction substantially perpendicular to said elongate terminal lug for assisting in removing the electrical contact element from said associated electric lamp socket.

16. The electrical contact member according to claim 14 wherein:

said lower leg member has a first width B;

said elongate terminal lug has a second width b, the second width b being less than half of said first width B;

the elongate terminal lug and the contact arm have a first material thickness D; and, the U-shaped intermediate region and the contact zone have a second material thickness d, the second thickness d being less than said first thickness D.

17. The electrical contact member according to claim 14 wherein the electrical contact member is a unitary construction and formed of as a single piece.

18. The electrical contact member according to claim 14 wherein the electrical contact member is formed of at least two pieces connected together including said contact arm and said elongate terminal lug having said first material thickness D and said U-shaped intermediate region having said second material thickness d.

19. An electrical contact element for use in an associated electric lamp socket to make electrical contact with an electric lamp positioned in the lamp socket, the electrical contact element comprising:

an elongate terminal lug on a first end of the electrical contact element, the elongate terminal lug extending in a first direction;

a contact zone disposed on a second end of the electrical contact element, the contact zone being laterally offset on the electrical contact element relative to said first direction of the elongate terminal lug; and, a U-shaped intermediate region disposed between the elongate terminal lug and the contact zone, the U-shaped intermediate region including an upper leg member, an intermediate leg member, and a lower leg member, said relative lateral offset between the contact zone and the elongate terminal lug being formed by the upper leg member, the intermediate leg member, and the lower leg member of the U-shaped intermediate region.

20. The electrical contact element according to claim 19 further including a connection arm member disposed between the contact zone and the U-shaped intermediate region.

* * * * *